US006776216B1

(12) United States Patent
Hohenbichler et al.

(10) Patent No.: US 6,776,216 B1
(45) Date of Patent: Aug. 17, 2004

(54) CASTING WHEEL

(75) Inventors: Gerald Hohenbichler, Kronstorf (AT); Stefano Pellissetti, Linz (AT); Armin Schertler, Guntramsdorf (AT); Romeo Capotosti, Narni (IT); Riccardo Tonelli, Rome (IT)

(73) Assignee: Voest-Alpine Industrieanlagenbau GmbH (AT)

( * ) Notice: Subject to any disclaimer, the term of this patent is extended or adjusted under 35 U.S.C. 154(b) by 0 days.

(21) Appl. No.: 09/423,067

(22) PCT Filed: Apr. 29, 1998

(86) PCT No.: PCT/EP98/02533

§ 371 (c)(1),
(2), (4) Date: Dec. 10, 1999

(87) PCT Pub. No.: WO98/50183

PCT Pub. Date: Nov. 12, 1998

(30) Foreign Application Priority Data

May 2, 1997 (IT) ..... RM97A0257

(51) Int. Cl.[7] ..... B22D 11/06
(52) U.S. Cl. ..... 164/428; 164/429; 164/443
(58) Field of Search ..... 164/428, 429, 164/442, 443, 448, 348, 479, 485; 165/89

(56) References Cited

U.S. PATENT DOCUMENTS

| | | | | | |
|---|---|---|---|---|---|
| 3,537,506 | A | * | 11/1970 | Griffiths | 164/276 |
| 4,442,883 | A | * | 4/1984 | Yamakami et al. | 164/448 |
| 4,537,239 | A | * | 8/1985 | Budzyn et al. | 164/423 |
| 4,842,040 | A | * | 6/1989 | Bibler et al. | 164/429 |
| 4,944,342 | A | * | 7/1990 | Lauener | 164/485 |
| 4,993,478 | A | * | 2/1991 | George, II | 164/479 |
| 5,152,333 | A | * | 10/1992 | Barbe et al. | 164/423 |
| 5,469,909 | A | * | 11/1995 | Sasaki et al. | 164/428 |
| 5,522,448 | A | * | 6/1996 | Righi | 164/122 |
| 5,651,410 | A | * | 7/1997 | Perry et al. | 164/428 |

FOREIGN PATENT DOCUMENTS

| | | | | |
|---|---|---|---|---|
| DE | 1939849 | | 2/1970 | |
| DE | 19612202 | | 10/1996 | |
| DE | 196 12 202 | A1 * | 10/1996 | B22D/11/06 |
| EP | 0219443 | | 3/1989 | |
| GB | 2 324 488 | * | 10/1998 | B22D/11/06 |
| IT | 92/1971 | | 11/1995 | |

* cited by examiner

*Primary Examiner*—M. Alexandra Elve
*Assistant Examiner*—Kevin P. Kerns
(74) *Attorney, Agent, or Firm*—Ostrolenk, Faber, Gerb & Soffen, LLP

(57) ABSTRACT

A casting wheel for the continuous casting of strips of metal has a core and sleeve of heat-conductive material which is shrunk on the core, and circumferential cooling ducts arranged between the core and the sleeve, which are connected with coolant supply line and coolant discharge line. The coolant is guided from the radially extending supply line into cooling ducts and from cooling ducts into the radially extending discharge line by means of a guiding element that can be inserted in cooling ducts.

5 Claims, 3 Drawing Sheets

CASTING WHEEL

FIELD OF THE INVENTION

The invention relates to a casting wheel for the continuous casting of strips of metal, preferably strips of ferrous metal within a thickness range between 1 mm and 12 mm, comprised of a core and a sleeve made of heat-conductive material, which is shrunk on the core, circumferential cooling ducts being located between the core and the sleeve, which are connected with coolant supply and discharge lines.

BACKGROUND OF THE INVENTION

Arrangements for the production of strips of ferrous metal with near-net-shape cross section in a continuous casting process are known. In this process, liquid steel is continuously fed from an intermediate vessel onto a rotating casting wheel in a desired layer thickness and taken from the casting wheel after it has fully or partly solidified (single-wheel strip casting). Near-net-shape strips can also be produced by feeding the liquid steel into a liquid sump formed by two casting wheels rotating in opposite directions and by side walls, the molten metal solidifying on the cooled casting wheel surface and forming two strand shells which are connected to form a casting strand in the smallest cross section between the two casting wheels, which has a defined thickness as a function of the distance between the two casting wheels (twin-wheel strip casting).

A casting wheel of the type applied in twin-wheel strip casting is known from IT-PS 1 255 817. This casting wheel is comprised of a core and a sleeve shrunk on the core, in which circular, discontinuously circumferential cooling ducts are installed. Coolant is centrally fed through the central shaft to the circular cooling ducts via radially arranged collecting mains and analogously discharged from there. The thickness of the sleeve changes at the transition between the collecting mains and the cooling ducts, which is due to the discontinuously circumferential cooling ducts which serve to separate coolant being fed from coolant being discharged and which leads to different radial and axial deformations of the sleeve at this point during operation, which are detrimental both to the production process and to the product itself. Deformations cause thickness variations of the product. Moreover, as the sleeve is alternately heated and cooled in accordance with the rotation of the casting wheel, the sleeve slowly twists in relation to the core, which cannot be completely remedied even if a form-fitting anti-rotation device is installed.

This torsion may lead to a short-circuit flow between the supply line and the discharge line to a great extent, which must be prevented by all means.

A solution where these disadvantages are eliminated is known from DE-OS 196 12 202, which proposes a generic casting wheel featuring a sleeve with circular, continuous cooling ducts installed in the sleeve, which is shrunk on a core. Starting from the collecting mains, coolant is fed into the cooling ducts on both sides and, having passed through 180°, exits the casting wheel at the opposite side and flows into collecting mains. This solution has the essential disadvantage that the amount of coolant required for cooling doubles while the flow velocity required to achieve the desired cooling effect and resulting from branching of the coolant flow is kept constant. The increased demand for coolant can be counteracted by using it twice, as stated in DE-OS 196 12 202 for a special embodiment. However, this method involves the disadvantage of a complicated core design. Moreover, axial zones are formed due to this complex coolant flow guidance, with coolant of different temperatures flowing through the cooling ducts adjacent to these zones. As a result, the mean casting wheel temperature clearly varies also in these transition regions or in the different axial zones, and particularly a jump of temperature occurs at the transition from one axial zone to the next one. These temperature changes represent a heavy mechanical load on the core and on the sleeve and also impair the cast strip of metal, since uniform thermal conditions in axial direction are absolutely essential in order to achieve a high strip quality. In addition, the flow may not be guided uniformly enough into the circular cooling ducts, which occurs, for example, in case of contamination.

OBJECTS OF THE INVENTION

The object of the invention is to avoid these disadvantages and difficulties and to create a casting wheel of the type described at the beginning, which provides for a uniform dissipation of heat from the sleeve at minimized coolant consumption and clearly defined flow conditions and also allows for the thermal tendency of the sleeve toward offset relative to the core. Another object of the invention is to provide a casting wheel of simple design that requires simple manufacturing methods, whose sleeve is rotationally symmetric and whose thermal expansion is mechanically unimpeded.

SUMMARY OF THE INVENTION

This technical problem is solved by a casting wheel of the type described at the beginning in that the guidance of coolant from the basically radial supply line into the cooling ducts and the guidance of coolant from the cooling ducts into the basically radial discharge line is caused by a guiding element that can be installed in the cooling ducts.

In any embodiment of the invention, one guiding element is allocated to each cooling duct. A preferred embodiment which is easy to mount is characterized in that a common guiding element is allocated to several adjoining cooling ducts.

The guiding element is comb-shaped, the width and depth of the individual teeth largely corresponding to the width and depth of the cooling ducts. An embodiment easy to manufacture is achieved by designing the guiding element with individual plate-shaped elements alternately forming teeth and intervals and held together by a connecting element, preferably a bolt, which threads with the individual plate-shaped elements.

In a preferred embodiment of the invention, a defined gap is set between the sleeve and the guiding element, particularly between the bottom of the cooling ducts and the face of the guiding element. This defined gap allows a desirable leakage flow between the inflow area and the outflow area whose extent is predetermined, which leads to a highly axisymmetrical behavior of the sleeve. Particularly favorable conditions are attained by dimensioning the gap as a function of the length of the guiding element, which varies in depth, in such a way that the mean velocity of coolant flow in the gap corresponds to the coolant flow velocity in the other regions of the cooling ducts. The gap between the guiding element and the sleeve is thus dimensioned so that in the area of the guiding element similar cooling conditions are attained as occur in any other region of the sleeve. For a gap length of 50 mm, gap widths ranging from approx. 0.3 to 0.8 mm are calculated depending on the pressure difference and mean velocity of coolant flow (4 to 15 m/s).

The coolant is guided from the radial supply line into the circular cooling ducts and vice versa in a way that favorable flow conditions are achieved by designing the teeth of the guiding element progressively divergent in radial direction toward the bottom of the cooling ducts.

In another embodiment, the teeth of the guiding element are preferably degressively convergent in radial direction. Since a very narrow face of the guiding element is opposite the bottom of the cooling ducts in this case, the risk of the gap between these two components becoming clogged is minimized or negligible, and the danger of great asymmetric deformations resulting from nonaxisymmetrical thermal conditions is also kept at a minimum.

In another embodiment, the thermal conditions in the sleeve are additionally equalized by staggering individual guiding elements or groups of several guiding elements arranged side by side in the direction of the longitudinal axis of the casting wheel by an angle in relation to the longitudinal axis of the casting wheel. A casting wheel of simple structure is obtained by aligning all guiding elements parallel to the longitudinal axis of the casting wheel.

In order to facilitate mounting and positioning, the guiding element is connected with the core by means of a plug connection. The guiding element is preferably connected with a partition between the coolant supply line and the coolant discharge line by means of a plug connection. The partition forms part of the core. According to the invention, the plug connection is essentially formed by a groove located parallel to the longitudinal axis of the casting wheel.

The guiding element is preferably made of a material that is equally heat-conductive as or less heat-conductive than the sleeve so as to reliably prevent any mounting problems or seizing in the cooling duct.

BRIEF DESCRIPTION OF THE DRAWINGS

In the following, the invention is explained in greater detail by the following drawings, where FIG. 1 schematically represents a twin-wheel strip casting machine with a casting wheel according to the invention.

DESCRIPTION OF THE PREFERRED EMBODIMENTS

A twin-wheel strip casting machine for the continuous casting of strips made of ferrous metal within a thickness range between 1 mm and 12 mm is comprised of two driven casting wheels 1 contrarotating in the direction of the arrow with parallel longitudinal axes 2.

Figure 1:
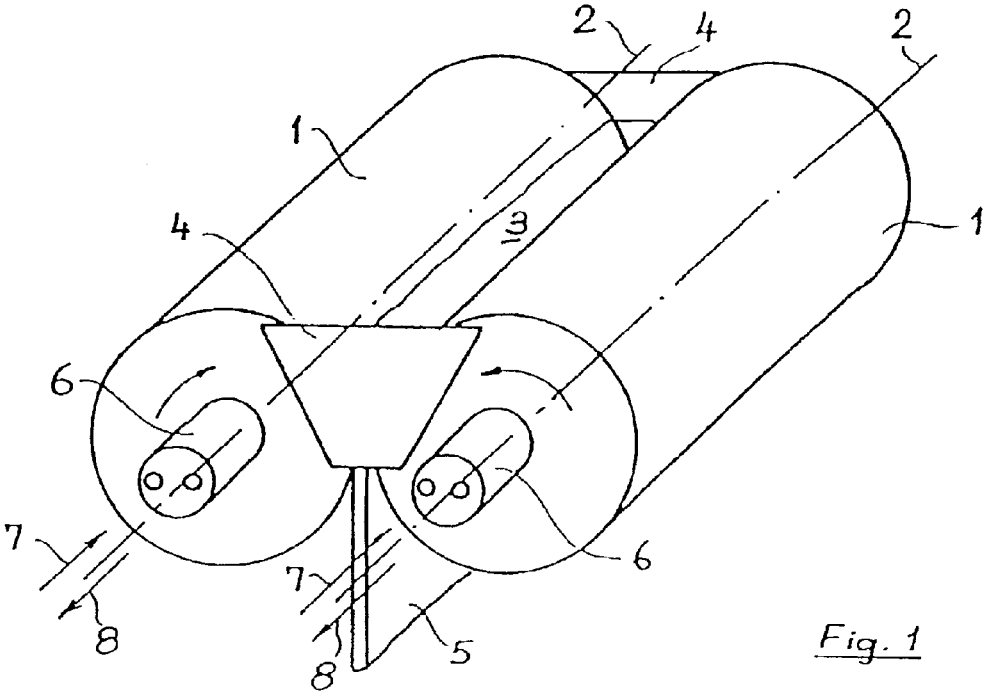

Liquid sump 3, into which the liquid steel is continuously charged, is comprised of two casting wheels 1 and side walls 4 which can be adjusted at the faces of the casting wheels. The continuously produced strip of ferrous metal 5 is withdrawn downward. Coolant is fed through central shaft 6 in the direction of arrow 7 and, after passing through and cooling the casting wheel surface from inside, discharged in the direction of arrow 8. A twin-wheel strip casting machine of this type is represented in FIG. 1 of IT-PS 1 255 817.

Figure 2:
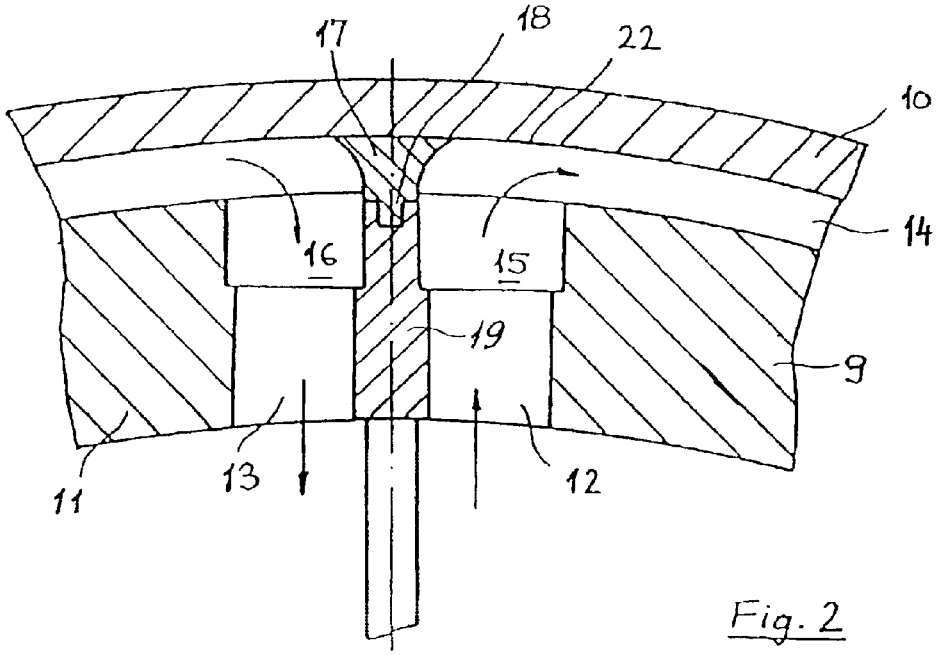
FIG. 2 depicts a detail section of a casting wheel with a first embodiment of the guiding element according to the invention.

FIG. 2 displays an example of the inner structure of a first embodiment of casting wheel 1 which is comprised of core 9 and sleeve 10. Core 9 is comprised of steel drum 11 consisting of a central shaft not represented here and various side walls and reinforcement ribs of welded design. Steel drum 11 is provided with openings forming supply line 12 and discharge line 13 for coolant, which is supplied and discharged through central shaft 6. The details of the coolant circuit between central shaft 6 and supply line 12 and discharge line 13 are not represented but can be designed analogously to the embodiment represented in IT-PS 1 255 817.

The inside of sleeve 10 which can be made of copper or copper alloy is provided with circular, continuously circumferential cooling ducts 14 to which coolant is fed through supply line 12 in the direction of the arrow and discharged through discharge line 13 in the direction of the arrow after flowing through cooling duct 14. Coolant distribution chamber 15 into which supply line 12 widens and which extends in the direction of longitudinal axes 2 of the casting wheel is allocated to several of circular cooling ducts 14 arranged side by side.

Analogously, discharge line 13 widens into a coolant collecting chamber 16 in its transition region from cooling ducts 14. This yields in a mechanically simple structure of core 9. Cooling ducts 14 may also be helically integrated into sleeve 10.

In the transition region between supply and discharge lines 12, 13 or coolant distribution chamber 15 or coolant collecting chamber 16 and cooling ducts 14, guiding element 17 is provided for the defined guidance of coolant and for dividing the flows of coolant between supply line 12 and discharge line 13. Guiding element 17 is connected with partition 19 between supply line 12 and discharge line 13 by means of plug connection 18.

Figure 3A:
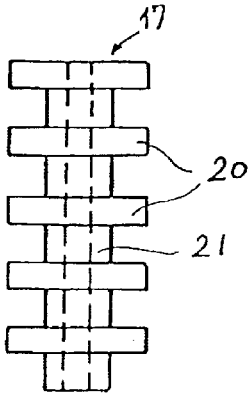
FIGS. 3*a* and 3*b* depict views of the guiding element according to the invention.
Figure 3B:
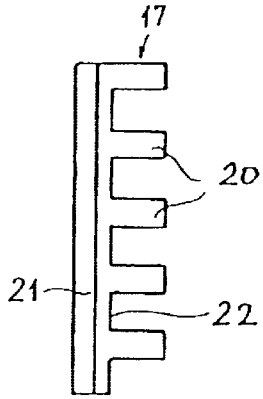
Figure 7:
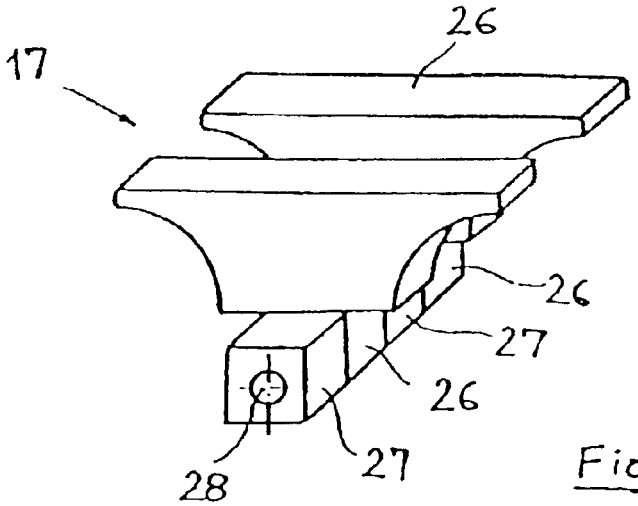
FIG. 7 depicts an oblique view of a guiding element comprised of individual elements.

As shown in FIG. 3*a* and FIG. 3*b*, guiding element 17 is provided with several teeth 20 which project upward from base 21 and whose spacing, width and depth are adjusted to the spacing, width and depth of cooling ducts 14. According to an embodiment represented in FIG. 7, which is simple with regard to manufacturing technology, guiding element 17 may consist of individual plate-shaped elements 26, 27 which alternately form teeth and intervals or base elements and which are held together by means of a connecting element, preferably a bolt 28, which threads with the individual plate-shaped elements.

Figure 4:
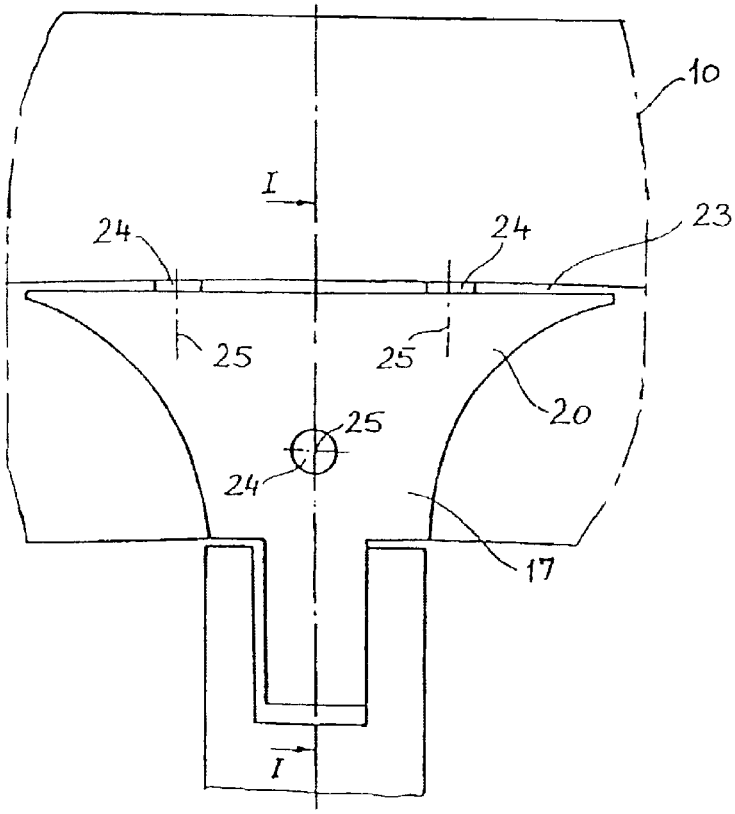
FIG. 4 depicts a detail section of a casting wheel analogously to FIG. 1 with a second embodiment of the guiding element.

As shown in FIGS. 3*a*, 3*b*, and 4 teeth 20 are progressively divergent toward bottom 22 of the cooling duct, which ensures improved guidance of coolant. Base 21 is designed to match plug connection 18 and its face connected with partition 19 by slide fit. For mounting purposes, guiding element 17 is glued on sleeve 10 in cooling ducts 14. However, the glued joint should be easily detachable.

Figure 5:
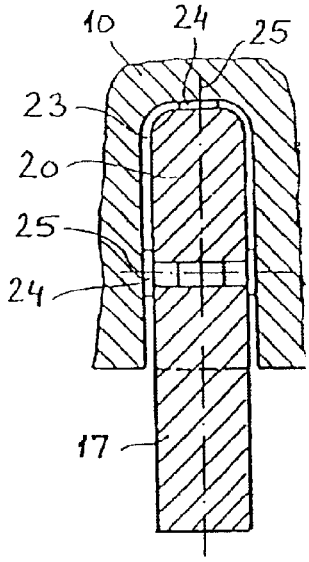
FIG. 5 depicts a cross section along line I—I in FIG. 4.

FIG. 4 and FIG. 5 display a guiding element 17 with a defined gap 23 between teeth 20 of guiding element 17 and the walls of cooling ducts 14 in sleeve 10. In order to adjust the defined gap 23, the faces and side walls of teeth 20 are provided with spacers 24 inserted in blind holes. The blind holes are indicated by their center lines 25.

Figure 6:
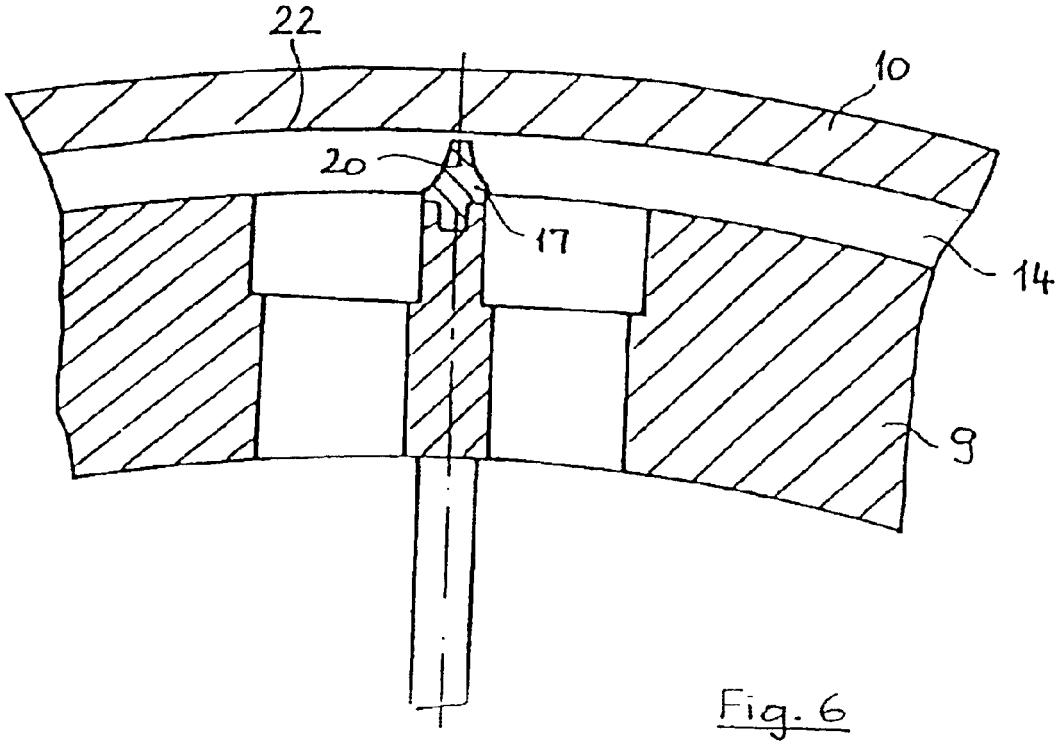
FIG. 6 depicts a detail section of a casting wheel analogously to FIG. 1 with a third embodiment of the guiding element.

FIG. 6 depicts an embodiment of guiding element 17 with teeth 20 tapering in radial direction to bottom 22 of the cooling duct. In all other structural elements, this embodiment corresponds to the embodiment according to FIG. 2.

What is claimed is:

1. A casting wheel for continuous casting of strips of metal comprising:

a cylindrical core extending along a longitudinal axis;

a cylindrical sleeve made of heat-conductive material and shrunk about the core;

a plurality of circumferential cooling ducts spaced axially from one another and located between the core and the sleeve;

a coolant supply line and a coolant discharge line which extend radially through the core, the coolant supply line and the coolant discharge line being spaced from one another and in flow communication with a respective cooling duct; and at least one guiding element extending radially between the core and the sleeve and separating the coolant supply line from the coolant discharge line, the guiding element on one end forms a plug, the plug detachably inserts into the core.

2. The casting wheel defined in claim 1, wherein the core has at least one radially extending partition between a pair of said supply and discharge lines, said guiding element being detachably inserted into said partition.

3. The casting wheel defined in claim 2, wherein said guiding element has a peripheral wall tapering radially inwardly toward said core.

4. The casting wheel defined in claim 2, herein said guiding element has a peripheral wall flaring radially inwardly toward said core.

5. The casting wheel defined in claim 1, wherein said at least one guiding element extends radially between the core and the sleeve and forms a gap with the sleeve, the guiding element has a length and a variable depth, the gap being dimensioned as a function of the length and the variable depth in such a way that the mean velocity of coolant flow in the gap corresponds to the mean velocity of coolant flow in the other regions of the cooling ducts.

* * * * *